United States Patent [19]

Junginger et al.

[11] Patent Number: 4,644,236

[45] Date of Patent: Feb. 17, 1987

[54] DRIVE RESTART CONTROL FOR RING SPINNING OR TWISTING MACHINE

[75] Inventors: Helmut Junginger, Kuchen; Horst Wolf, Albershausen; Wolfgang Jäger, Uhingen, all of Fed. Rep. of Germany

[73] Assignee: Zinser Textilmaschinen GmbH, Ebersbach, Fed. Rep. of Germany

[21] Appl. No.: 692,901

[22] Filed: Jan. 18, 1985

[30] Foreign Application Priority Data

Jan. 24, 1984 [DE] Fed. Rep. of Germany ..... 3402225

[51] Int. Cl.[4] ..... H02P 5/00

[52] U.S. Cl. ..... 318/309; 318/338; 318/446; 318/449; 318/663

[58] Field of Search ..... 318/39, 51, 68, 101, 318/102, 103, 264, 265, 266, 267, 272, 275, 277, 279, 295, 309, 305, 306, 308, 445, 446, 449, 549, 626, 663, 666, 668, 671, 672, 778, 338

[56] References Cited

U.S. PATENT DOCUMENTS

| | | | |
|---|---|---|---|
| 1,485,409 | 3/1924 | Miller | 318/309 |
| 2,385,454 | 9/1945 | Lehde | 318/449 X |
| 2,407,555 | 9/1946 | Kettering | 318/446 X |
| 2,963,590 | 12/1960 | Schultz et al. | 318/102 X |
| 3,122,689 | 2/1964 | Atkinson | 318/663 |
| 3,184,662 | 5/1965 | Wallace | 318/663 X |
| 3,191,284 | 6/1965 | Eurey | 29/401 |
| 3,405,340 | 10/1968 | Ankenman et al. | 318/338 X |
| 3,418,547 | 12/1968 | Dudler | 318/663 X |
| 3,465,223 | 9/1969 | Mears | 318/329 X |
| 3,559,017 | 1/1971 | Dinger | 318/341 X |
| 3,678,351 | 7/1972 | Shemanske | 318/329 X |
| 3,697,849 | 10/1972 | Uchida | 318/663 X |
| 3,757,179 | 9/1973 | Pedersen | 318/101 X |
| 4,078,198 | 3/1978 | Murakosi et al. | 318/663 X |
| 4,211,967 | 7/1980 | Akiyama et al. | 318/314 X |
| 4,491,905 | 1/1985 | Arakawa | 318/446 X |
| 4,518,899 | 5/1985 | Wolf | 318/68 |

FOREIGN PATENT DOCUMENTS

| | | |
|---|---|---|
| 49206 | 7/1966 | Fed. Rep. of Germany . |
| 2051754 | 4/1972 | Fed. Rep. of Germany . |

OTHER PUBLICATIONS

EDN, Aug. 5, 1977, vol. 22, No. 14.

*Primary Examiner*—Bernard Roskoski
*Assistant Examiner*—Shik Luen Paul Ip
*Attorney, Agent, or Firm*—Karl F. Ross; Herbert Dubno

[57] ABSTRACT

A device for controlling the output speed of a motor of a ring spinning machine, a ring twisting machine and the like in case of replacing travelers of such machines includes a speed setter for the motor and a potentiometer which is operatively connected with the speed setter to limit the output speed of the motor for allowing breaking in of replaced travelers. The potentiometer is further coupled with a speeding-up unit which is e.g. a stepper motor and which over a selected period of time increases the limited output speed to the normal operating level by automatically resetting the slider of the potentiometer from one end position to another end position.

14 Claims, 6 Drawing Figures

DRIVE RESTART CONTROL FOR RING SPINNING OR TWISTING MACHINE

FIELD OF THE INVENTION

Our present invention relates to a drive restart control for a ring spinning machine or for a ring twisting machine and, more particularly, to a device for controlling the output speed of a motor in a ring spinning machine, ring twisting machine or the like during restarting after traveler replacement.

BACKGROUND OF THE INVENTION

Ring spinning machines or ring twister machines are provided with travelers running around on rings and acting as yarn guides, for inserting twists and for winding the yarn at proper tension onto the bobbin. Since these travelers are subjected to substantial stress, they wear out after a certain period and thus must be replaced. It is, however, not advisable to wait until individual travelers become defective because this leads to thread breakage and to nonuniform spinning.

Furthermore, replacement of individual travelers is not feasible since replaced travelers must be started with reduced running speed although the spindles of the associated set of travelers are commonly driven. Consequently, all travelers of one machine or one machine side must be replaced in common.

The time intervals within which a replacement has to be made depends on the speed of the spindles and on other factors and may amount to about three weeks. Once a replacement has been provided, the set of new travelers is run at reduced speed that is a half or a quarter of the normal operating speed and then are gradually, generally within a period of two or three hours, accelerated to the normal operating speed.

Up to now, the adjustment of the speed has been manually performed by increasing the speed of the driving motor at short time intervals—e.g. every quarter of an hour—by a certain magnitude until the normal operating speed of the travelers is obtained.

It is obvious that such a manual control requires continuous supervision and demands special attention from the operator. Nevertheless, experience has shown that even with such special attention, manual systems involve an uneven breaking or running in of the travelers.

OBJECTS OF THE INVENTION

It is thus the principal object of the present invention to provide a control device which allows automatic adjustment of the speed of the motor driving the travelers and to obtain an even breaking in of the travelers.

Another object is to provide an improved restart control for a ring spinning or ring twisting frame which avoids the drawbacks of earlier machines after a traveler change or replacement.

SUMMARY OF THE INVENTION

We realize these objects, in accordance with the invention, by connecting a speed setter, which actuates the motor to drive the spindles at a certain but controlled speed, with control means to initially limit and then gradually increase over a selected time period the output speed to the normal operating level upon restarting of the machine.

We have found it especially advantageous to have the control means initially limit the output speed to a magnitude between 50% and 75% of the normal operating value and then progressively increase this speed to the normal value over a predetermined time span either in steps or continuously.

With the provision of the control device according to the present invention, the breaking in of the travelers is automatic, and it requires only a switching on of the control means to actuate the motor to run at first at the selected minimum reduced speed (i.e. to automatically accelerate from zero speed to this minimum) and then to automatically and gradually decrease the speed limitation, i.e. to increase the output speed over the selected time period and according to a desired progression.

According to the teachings of the invention, the control means includes a potentiometer whose slider is operatively connected with the speed setter and whose tapped potential and thus respective position along the sliding contact is proportional to the output speed with which the spindles are driven by the motor. Preferably, the potentiometer is provided with an adjustable end stop which is arranged at such a location that the tapped potential corresponds to the limited output speed (i.e. to the aforementioned minimum) when the slider is positioned against this end stop, and is provided with a further end stop. When the slider abuts against the further end stop, the motor and thus the spindles run at normal output speed.

Connected to the slider of the potentiometer is a speeding-up unit in form of a stepping, servo or other progressive advance motor which moves or resets the slider from the one end stop to the further end stop to increase the tapped potential and thus the output speed from the minimum to the normal operating level whereby the respective tapped potential is proportional to the corresponding output speed of the spindles.

According to a further feature of the invention, the control means can use electronic elements instead of the electromechanical parts. Accordingly, the control means of the invention can include a microprocessor which cooperates with a speeding-up unit designed as set-point adjusters for respectively transmitting the normal operating speed for the spindles, the limited output speed provided for breaking in the travelers and the time period and timed progression for the increase of the output speed from the limited level to the normal operating level.

BRIEF DESCRIPTION OF THE DRAWING

The above and other objects, features and advantages of our invention will become more readily apparent from the following description with reference to the accompanying drawing in which.

SPECIFIC DESCRIPTION

Figure 1:
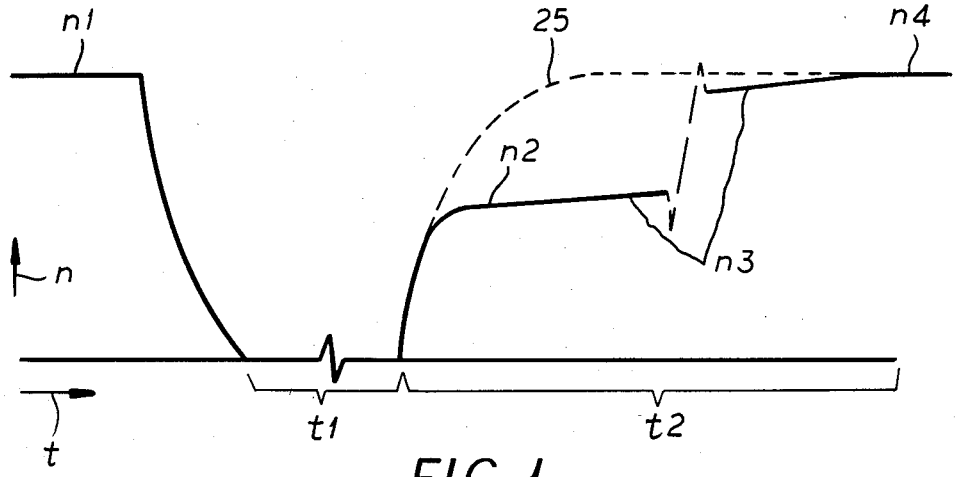
FIG. 1 is a graphical illustration of the spindle speed as a function of the time.

In FIG. 1, we have shown the change of the speed over various time intervals. Before the main driving motor 1 of a respective ring spinning machine or ring twisting machine 2 is stopped, the motor 1 runs at an operational speed n1. Once it becomes necessary to replace a set of travelers, the motor 1 is turned off, thus causing a rapid drop of the speed to zero. After a time interval t1 during which the replacement is performed, the drive motor 1 is restarted and accelerates quickly to a speed n2 which corresponds to about 50% of the normal operational speed n1, i.e. is the minimum speed mentioned previously.

The motor is then controlled to increase gradually the speed—as characterized by the ramp n3—over a time interval t2 at the end of which a speed n4 is obtained which corresponds to the normal operational speed of the travelers.

Figure 2:
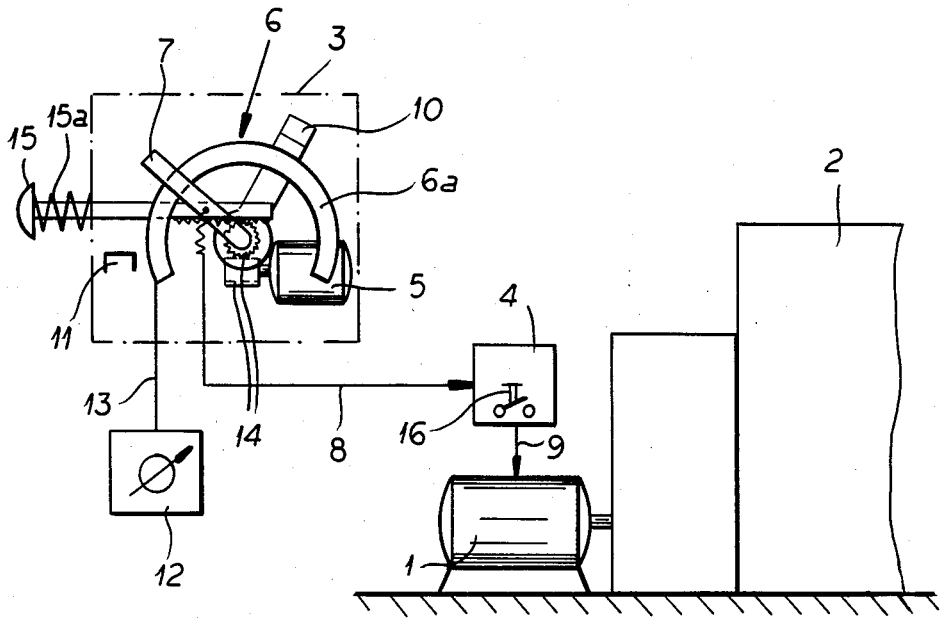
FIG. 2 is a schematic view of a first embodiment according to the invention.

FIG. 2 depicts a first embodiment of a control device for adjusting the speed of a main motor 1 which is part of an associated ring spinning machine or ring twisting machine 2. The main motor 1 drives in dependence on the control device a plurality of spindles (not shown) which in turn provide the rotation of connected travelers (not shown).

The control device includes a control unit which is generally characterized by reference numeral 3. The control unit is provided with a potentiometer 6 whose slider 7 is movable along the sliding resistive element **6*a* to provide respective potentials which are proportional to the respective output speed of the spindles. Via a line 8, the slider 7 is operatively connected to a speed setter 4 whose output signal is transmitted to the motor 1 via line 9 in dependence on the position of the slider 7 along the resistive element 6*a***.

Consequently, the speed setter 4 provides an electric voltage via the line 9 to the main motor 1 which voltage corresponds to the output signal transmitted via line 8 by the position of the slider 7. The speed setter 4 and thus the motor 1 can be turned off by an on/off switch 16 so as to allow replacement of respective travelers.

As can be seen from FIG. 2, the slider 7 is movable between an end stop 10 and an end stop 11. When it abuts against the end stop 10, the slider 7 is in a position in which an output signal is transmitted via line 8 to the speed setter 4 corresponding to the reduced speed n2 so that the speed setter 4 will actuate the motor 1 accordingly.

In order to automatically move the slider 7 along the sliding contact **6*a* in direction towards the end stop 11 and thus allow the speed to be correspondingly increased, the control device includes a speeding-up unit 5 whose motor is connected to the slider 7 via a gearing 14. The motor of the speeding-up unit 5 can be of various types depending on the requirements and is turned on once the switch 16 is pushed into the on-position. By using a step-by-step switch mechanism the gradual increase of the speed n3** can be provided in small steps which need not necessarily be linear while the use of a stepper motor is advantageous in case a linear increase of the speed is desired. A servomotor on the other hand can be used for all purposes.

By means of the speeding-up unit 5, the slider 7 is gradually moved within the selected time interval t2 towards the end step 11 thus being reset into the position corresponding to the potential which is proportional to the normal operating speed of the spindles. The position of the slider 7 at the end stop 11 and thus the magnitude of the corresponding potential can be modified by adjusting the end stop 11 accordingly. In addition, the amount of the tapped potential at the end stop 11 which is proportional to the normal operating speed n4 can be set by a speed selector 12. Via line 13, the speed selector is operatively connected to the potentiometer 6. The speed selector 12 allows a preselection of a desired normal operating speed by choosing a respectively high potential.

In order to permit the slider 7 to be moved towards the end stop 10, a set member 15 is fixed to the slider 7 and extends to the outside. Via a spring **15*a*, the set member 15 is biased. Thus when switch 16 is closed the member 15 can be pressed in to start motor 5 and begin the break in period according to FIG. 1**.

Figure 3:
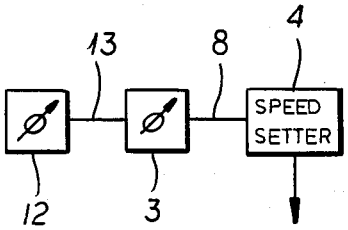
FIG. 3 is a circuit diagram of the first embodiment.
Figure 4:
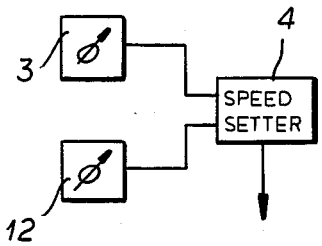
FIG. 4 is a different circuit diagram of the first embodiment.

From the block diagram of FIG. 3, it can be seen that the speed selector 12 and the control unit 3 are connected in series (as in FIG. 2) while as alternative, FIG. 4 discloses a parallel connection of speed selector 12 and control unit 3.

After having described the individual parts of the invention, we will now explain in detail the mode of operation.

When a replacement of the travelers is needed, the speed setter is turned off by pushing the switch 16 into the off-position so that the respective spindles are rapidly brought to a stop from speed n1. Thereafter, the travelers can be replaced by new ones. During the replacement (time t1), the control device is prepared for the restart by actuating the set member 15 to position the slider 7 against the end stop 10. This position of the slider 7 corresponds to the rotational spindle speed n2 which is about 50% of the normal operating speed n4. The speed selector 12 can remain in its set value or may be set to a different normal operating speed.

After having replaced the travelers and having positioned the slider 7, the switch 16 is pushed into the on-position so that the main motor 1 which is actuated by the speed setter 4 in dependence on the position of the slider 7 drives the spindles to rotate at the speed n2. Simultaneously, the motor of the speeding-up unit 5 receives a potential and thus shifts the slider 7 slowly in direction towards the end stop 11. The time period during which the slider 7 is returned to the end stop 11 is selectable. Preferably, the selected time period is between two and three hours. Consequently, with every shift of the slider 7 along the sliding contact **6*a*, the speed of the spindles is proportionally increased until the normal operating speed n4 is reached which coincides with the position of the slider 7 at the end stop 11. With this normal operating speed n4**, the spindles are then continuously driven.

Figure 5:
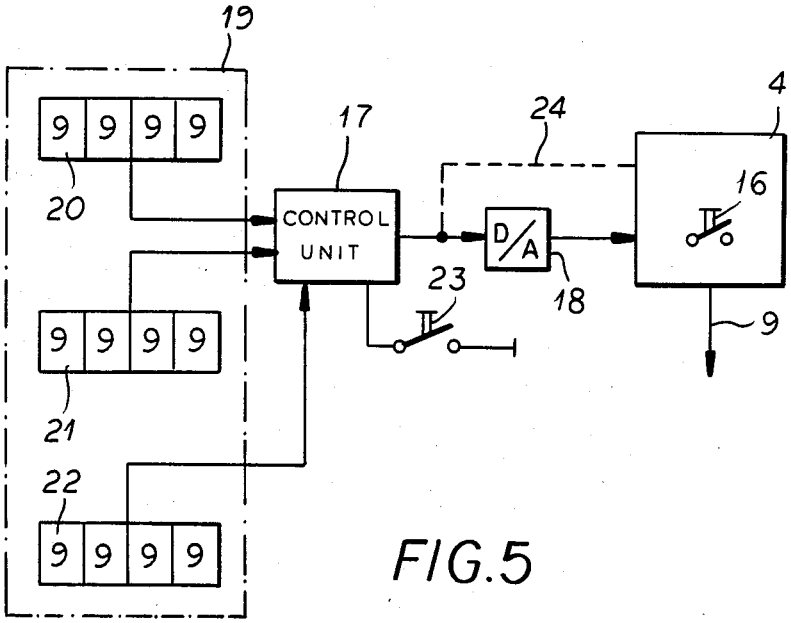
FIG. 5 is a circuit diagram of a second embodiment according to the invention.

In FIG. 5, a second embodiment of the invention is shown and having a control device including a control unit 17 provided in form of a microprocessor which is operatively connected to the speed setter 4 via a digital-to-analog converter 18 and to a speeding-up unit 19. The speeding-up unit 19 accommodates three set-point adjusters including a first set-point adjuster 20 for the normal operating speed n4 of the spindles, a second set-point adjuster 21 for the speed determining breaking in of the travelers and a third set-point adjuster 22 for the timer period and the progression of the speed in dependence on the time from the reduced speed to the normal operating speed. The input of the set points is provided in form of a four-digit number. In order to correctly assign the set-point adjusters 20, 21, 22 to the microprocessor 17, the latter is connected to a start switch 23 which when pushed down assigns the set-point adjusters 21, 22 to the microprocessor 17.

During the normal spinning operation, only the setting of the set-point adjuster 20 governs while the other set-point adjusters 21, 22 are irrelevant. However, once replacement of the travelers has been made and the switch 16 as well as the switch 23 are actuated, the microprocessor 17 is governed by the settings of the adjusters 21, 22 and thus the motor 1 drives the respective spindles at the reduced speed n2 and then increases to the normal operating speed n4. The progression of the speed is shown e.g. by the diagram of FIG. 1.

By means of the interposed digital-to-analog converter 18, the speed setter 4 is provided with analog signals. We may note, however, that depending on the design of the speed setter 4, it is also possible to provide a by-pass line 24 and to disconnect the digital-to-analog converter 18 in case the speed setter 4 can process also digital control signals.

In case, the travelers are already broken-in, the motor 1 can drive the spindles along line 25 as shown in FIG. 1.

Figure 6:
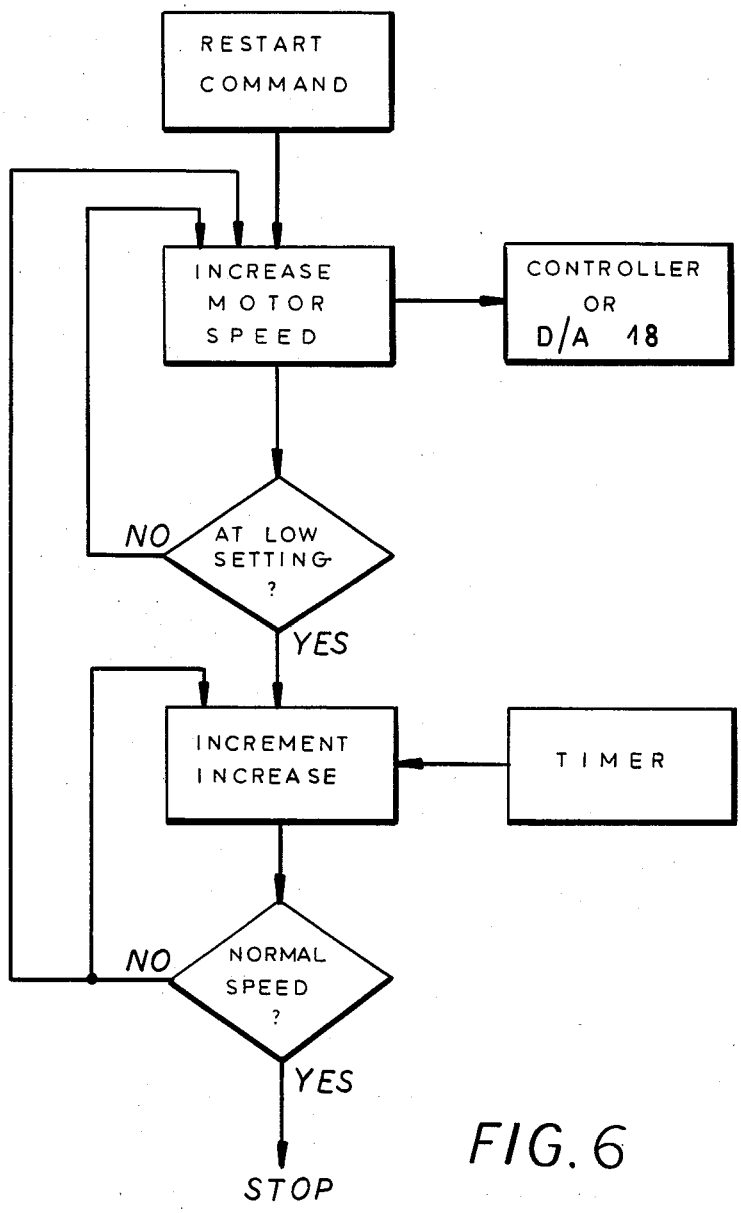
FIG. 6 is an information flow diagram illustrative of the operation of the microprocessor based system of FIG. 5.

The microprocessor can be programmed as shown in FIG. 6 so that the motor speed is first brought to the minimum without the timing control and only thereafter is the speed raised to normal.

We claim:

1. The combination with a ring spinning a ring twisting machine of a device for the controlled restarting of a drive motor for said ring spinning machine or ring twisting machine having a speed at a normal operating level comprising:

a speed setter providing an output signal for actuating the motor so that the latter runs at a speed corresponding to said output signal; and control means operatively connected with said speed setter and providing a further output signal which acts on said speed setter, said control means including a control unit for initially bringing the speed of said motor immediately to a predetermined value of between 50% and 75% of the normal operating level and a speeding-up unit for automatically increasing the speed progressively and continuously over a selected period having a lower limit of two hours from said predetermined value to said normal operating level.

2. A device as defined in claim 1 wherein said control unit includes a potentiometer having a sliding contact and a slider movable along said sliding contact between two end positions and being operatively connected to said speed setter, said further output signal corresponding to the respective position of said slider along said sliding contact and acting on said speed setter to provide a proportional output speed.

3. A device as defined in claim 2 wherein said potentiometer further includes a first end stop constituting one of said two end positions, said further output signal acting on said speed setter to provide said limited speed when said slider occupies said one position at said first end stop.

4. A device as defined in claim 3 wherein said potentiometer further includes a second end stop constituting the other one of said end positions, said further output signal acting on said speed setter to provide said normal operating speed when said slider occupies said other position at said second end stop.

5. A device as defined in claim 4 wherein said speeding-up unit is connected to said slider for shifting the latter along said sliding contact from said one end position to said other end position over a selected time period so as to allow an increase of the output speed from the limited level to the normal operating level which increase is proportional to the position of said slider along said sliding contact.

6. A device as defined in claim 1 wherein said speeding-up unit includes a stepping motor mechanism.

7. A device as defined in claim 1 wherein said speeding-up unit includes a stepper switch.

8. A device as defined in claim 1 wherein said speeding-up unit includes a servomotor.

9. A device as defined in claim 2 wherein said control unit further includes a speed selector operatively connected with said potentiometer for selecting the normal operating level of the output speed.

10. A device as defined in claim 9 wherein said speed selector and said control unit are switched in series.

11. A device as defined in claim 9 wherein said speed selector and said control unit are switched in parallel connection.

12. A device as defined in claim 1 wherein said control unit includes a microprocessor.

13. A device as defined in claim 12 wherein said speeding-up unit includes a plurality of set-point adjusters connected with said microprocessor, a first one of said set-point adjusters being provided for transmitting the normal operating level of the output speed, a second one for transmitting the limited output speed and a third one for controlling the time period and timed progression of increasing the output speed from the limited level to the normal operational level.

14. A method for controlling restarting of a drive motor having a speed of a normal operating level in a ring spinning machine or ring twisting machine comprising:

providing an output signal from a speed setter for actuating the motor so that the motor runs at a speed corresponding to said output signal; and operatively connecting control means with said speed setter and providing a further output signal which acts on said speed setter, said control means including a control unit for initially bringing the speed of said motor immediately to a predetermined value between 50% and 75% of the normal operating level and a speeding-up unit for automatically increasing the speed progressively and continuously over a selected period having a lower limit of two hours from said predetermined value to said normal operating level.

* * * * *